US011196168B2

(12) United States Patent
Wu et al.

(10) Patent No.: US 11,196,168 B2
(45) Date of Patent: Dec. 7, 2021

(54) ULTRA WIDE BAND RADIATORS AND RELATED ANTENNAS ARRAYS

(71) Applicant: CommScope Technologies LLC, Hickory, NC (US)

(72) Inventors: Ligang Wu, Suzhou (CN); Bo Wu, Suzhou (CN); Jing Sun, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 102 days.

(21) Appl. No.: 16/735,891

(22) Filed: Jan. 7, 2020

(65) Prior Publication Data

US 2020/0144725 A1 May 7, 2020

Related U.S. Application Data

(63) Continuation of application No. 15/443,125, filed on Feb. 27, 2017, now Pat. No. 10,566,695.

(51) Int. Cl.

| | |
|---|---|
| ***H01Q 9/44*** | (2006.01) |
| ***H01Q 1/24*** | (2006.01) |
| ***H01Q 15/14*** | (2006.01) |

(52) U.S. Cl.

CPC ..... *H01Q 9/44* (2013.01); *H01Q 1/246* (2013.01); *H01Q 15/14* (2013.01)

(58) Field of Classification Search

CPC ..... H01Q 9/44; H01Q 2851/246; H01Q 1215/14; H01Q 19/104; H01Q 21/26;

(Continued)

(56) References Cited

U.S. PATENT DOCUMENTS

| | | | |
|---|---|---|---|
| 8,228,256 | B2 | 7/2012 | Puente Baliarda et al. |
| 9,407,011 | B2 | 8/2016 | Zaghloul et al. |

(Continued)

FOREIGN PATENT DOCUMENTS

| | | | |
|---|---|---|---|
| CN | 1886864 | A | 12/2006 |
| CN | 102769174 | A | 11/2012 |

(Continued)

OTHER PUBLICATIONS

Notification of Transmittal of the International Search Report and the Written Opinion of the International Searching Authority, or the Declaration for International Application No. PCT/US2017/019598 (dated Jun. 12, 2017).

(Continued)

*Primary Examiner* — Seokjin Kim
(74) *Attorney, Agent, or Firm* — Myers Bigel, P.A.

(57) ABSTRACT

A multi-band radiating array includes a reflector, a plurality of first radiating elements defining a first column on the reflector, a plurality of second radiating elements defining a second column on the reflector alongside the first column, and a plurality of third radiating elements defining a third column on the reflector between the first and second columns. The first radiating elements have a first operating frequency range, the second radiating elements have a second operating frequency range that is wider than the first operating frequency range, and the third radiating elements have a third operating frequency range that is lower than the second operating frequency range. Related radiating elements are also discussed.

20 Claims, 12 Drawing Sheets

(58) Field of Classification Search
CPC .... H01Q 21/28; H01Q 21/08; H01Q 21/0006; H01Q 21/30
See application file for complete search history.

(56) References Cited

U.S. PATENT DOCUMENTS

| | | | | |
|---|---|---|---|---|
| 9,711,871 | B2 | 7/2017 | Jones | |
| 2003/0137456 | A1 | 7/2003 | Sreenivas et al. | |
| 2009/0224995 | A1* | 9/2009 | Puente | H01Q 9/0457 343/850 |
| 2010/0177002 | A1 | 7/2010 | Lee et al. | |
| 2012/0280878 | A1 | 11/2012 | Timofeev | |
| 2014/0139387 | A1 | 5/2014 | Jones et al. | |
| 2014/0347238 | A1 | 11/2014 | Beausang | |
| 2014/0375526 | A1 | 12/2014 | Ziv et al. | |
| 2015/0070234 | A1* | 3/2015 | Jones | H01Q 1/12 343/798 |
| 2015/0091767 | A1 | 4/2015 | Matitsine et al. | |
| 2015/0214617 | A1 | 7/2015 | Shang et al. | |
| 2015/0295313 | A1 | 10/2015 | Zimmerman et al. | |
| 2015/0372397 | A1 | 12/2015 | Jonsson et al. | |

FOREIGN PATENT DOCUMENTS

| | | | |
|---|---|---|---|
| CN | 204857971 | U | 12/2015 |
| CN | 205081235 | U | 3/2016 |
| FR | 2863110 | A1 | 6/2005 |

OTHER PUBLICATIONS

Supplementary European Search Report corresponding to European Application No. 17779481.5 (dated Nov. 8, 2019).
Chinese Office Action for corresponding Chinese Application No. 201610370866.0 (Foreign Text, 11 pages; English Translation, 13 pages) (dated May 15, 2020).
Chinese Office Action for corresponding Chinese Application No. 201610370866.0 (Foreign Text, 9 pages; English Translation, 7 pages) (dated Dec. 21, 2020).

* cited by examiner

| NAME | | MIN | MAX | MEAN | STDV | TOL |
|---|---|---|---|---|---|---|
| OVERALL | | 51.81 | 69.15 | 60.83 | 3.68 | 5.52 |

| NAME | MIN | MAX | MEAN | STDV | TOL |
|---|---|---|---|---|---|
| OVERALL | 52.66 | 72.41 | 63.25 | 4.18 | 6.27 |

ULTRA WIDE BAND RADIATORS AND RELATED ANTENNAS ARRAYS

CROSS REFERENCE TO RELATED APPLICATION

The present application is a continuation application of and claims priority to U.S. application Ser. No. 15/443,125, filed Feb. 27, 2017, which claims priority under 35 U.S.C. § 119 from Chinese Patent Application No. 201610370866.0, filed Apr. 8, 2016, the disclosures of which are incorporated by reference herein in their entireties.

FIELD

The present disclosure relates generally to communications systems and, more particularly, to array antennas utilized in communications systems.

BACKGROUND

Multi-band antenna arrays, which can include multiple radiating elements with different operating frequencies, may be used in wireless voice and data communications. For example, common frequency bands for GSM services include GSM900 and GSM1800. A low-band of frequencies in a multi-band antenna may include a GSM900 band, which operates at 880-960 MHz. The low-band may also include Digital Dividend spectrum, which operates at 790-862 MHz. Further, the low-band may also cover the 700 MHz spectrum at 694-793 MHz.

A high-band of a multi-band antenna may include a GSM1800 band, which operates in the frequency range of 1710-1880 MHz. A high-band may also include, for example, the UMTS band, which operates at 1920-2170 MHz. Additional bands may comprise LTE2.6, which operates at 2.5-2.7 GHz and WiMax, which operates at 3.4-3.8 GHz.

A dipole antenna may be employed as a radiating element, and may be designed such that its first resonant frequency is in the desired frequency band. To achieve this, each of the dipole arms may be about one quarter wavelength, and the two dipole arms together are about one half the wavelength of the desired band. These are referred to as "half-wave" dipoles, and may have relatively low impedance.

However, multi-band antenna arrays may involve implementation difficulties, for example, due to interference among the radiating elements for the different bands. In particular, the radiation patterns for a lower frequency band can be distorted by resonances that develop in radiating elements that are designed to radiate at a higher frequency band, typically 2 to 3 times higher in frequency. For example, the GSM1800 band is approximately twice the frequency of the GSM900 band. As such, the introduction of an additional radiating element having an operating frequency range different from the existing radiating elements in the array may cause distortion with the existing radiating elements.

There are two modes of distortion that are typically seen, Common Mode resonance and Differential Mode resonance. Common Mode (CM) resonance can occur when the entire higher band radiating structure resonates as if it were a one quarter wave monopole. Since the stalk or vertical structure of the radiator is often one quarter wavelength long at the higher band frequency and the dipole arms are also one quarter wavelength long at the higher band frequency, this total structure may be roughly one half wavelength long at the higher band frequency. Where the higher band is about double the frequency of the lower band, because wavelength is inversely proportional to frequency, the total high-band structure may be roughly one quarter wavelength long at a lower band frequency. Differential mode resonance may occur when each half of the dipole structure, or two halves of orthogonally-polarized higher frequency radiating elements, resonate against one another.

One approach for reducing CM resonance may involve adjusting the dimensions of the higher band radiator such that the CM resonance is moved either above or below the lower band operating range. For example, one proposed method for retuning the CM resonance is to use a "moat," described for example in U.S. patent application Ser. No. 14/479,102, the disclosure of which is incorporated by reference. A hole can be cut into the reflector around the vertical structure of the radiating element (the "feed board"). A conductive well may be inserted into the hole, and the feed board may be extended to the bottom of the well. This can lengthen the feed board, which may move the CM resonance lower and out of band, while at the same time keeping the dipole arms approximately one quarter wavelength above the reflector. This approach, however, may entail greater complexity and manufacturing cost.

In addition, a trade-off may exist between performance and spacing of the radiating elements in a multi-band antenna array. In particular, while array length may be used to achieve a desired beamwidth, it may be advantageous to reduce the number of radiating elements along the array length to reduce costs. However, reducing the number of radiating elements along the array length may result in increased spacing between the radiating elements, which may result in undesired grating lobes and/or attenuation.

SUMMARY

According to some embodiments of the present disclosure, a radiating element includes a plurality of arm segments defining at least one dipole antenna having a wideband operating frequency range. The radiating element further includes a stalk configured to suspend the arm segments above a planar reflector such that respective surfaces of the arm segments radially extend from an end of the stalk and parallel to the planar reflector. Corners of the respective surfaces of the arm segments are beveled or chamfered.

In some embodiments, the at least one dipole antenna may include first and second dipole antennas defined by opposing ones of the arm segments in a cross dipole arrangement, where the first and second dipole antennas may have respective arm lengths defined between opposing ends thereof.

In some embodiments, the respective arm lengths may be about one-half wavelength or more with respect to a lower bound of the wideband operating frequency range, and may be about one full wavelength or less with respect to an upper bound of the wideband operating frequency range. For example, the respective arm lengths may be about 0.8 of the full wavelength with respect to the upper bound of the wideband operating frequency.

In some embodiments, the corners of the respective surfaces of the arm segments are beveled or chamfered at an angle of less than about 70 degrees but greater than about 20 degrees relative to the respective arm lengths.

In some embodiments, the first and second dipole antennas may have respective arm widths in directions perpendicular to the respective arm lengths thereof. The respective arm widths may be greater than about one-half of the respective arm lengths.

In some embodiments, a director element may protrude from an intersection between the arm segments at the end of the stalk. The director element may include a surface that extends parallel to the respective surfaces of the arm segments and suspended thereabove.

In some embodiments, the radiating element may be a plurality of radiating elements respectively comprising the first and second dipole antennas in the cross dipole arrangement. The radiating elements may be aligned in a column to define an array. An inter-element spacing between adjacent ones of the radiating elements in the column may be about 115 millimeters (mm) in some embodiments.

In some embodiments, the stalk may be a feed board including feed lines that are configured to couple the arm segments to an antenna feed. A serially connected inductor and capacitor may couple respective ones of the arm segments to the stalk.

In some embodiments, the wideband operating frequency range may be about 1.4 GHz to about 2.7 GHz.

According to further embodiments of the present disclosure, a multi-band radiating array includes a reflector (e.g., a planar reflector), a plurality of first radiating elements defining a first column on the reflector, a plurality of second radiating elements defining a second column on the reflector alongside the first column, and a plurality of third radiating elements defining a third column on the reflector between the first and second columns. The first radiating elements have a first operating frequency range, the second radiating elements have a second operating frequency range that is wider (i.e., including a wider range of frequencies) than the first operating frequency range, and the third radiating elements have a third operating frequency range that is lower (i.e., including lower frequencies) than the second operating frequency range.

In some embodiments, at least the first and second radiating elements may respectively include a plurality of arm segments defining first and second dipole antennas in a cross dipole arrangement, and a stalk that suspends the arm segments above the planar reflector such that respective surfaces of the arm segments radially extend from an end of the stalk and parallel to the planar reflector. Corners of the respective surfaces of the arm segments of the second radiating elements may be beveled or chamfered.

In some embodiments, the first and second radiating elements may have a same inter-element spacing between adjacent ones thereof in the first and second columns, respectively. For example, the inter-element spacing may be about 115 mm.

In some embodiments, respective stalks of the first radiating elements of the first column may be laterally aligned with respective stalks of the second radiating elements of the second column to define respective rows.

In some embodiments, the first operating frequency range may be about 1.7 GHz to about 2.7 GHz, the second operating frequency range may be about 1.4 GHz to about 2.7 GHz (that is, including an entirety of the first operating frequency range), and the third operating frequency range may be about 694 MHz-960 MHz.

BRIEF DESCRIPTION OF THE DRAWINGS

Aspects of the present disclosure are illustrated by way of example and are not limited by the accompanying drawings. In the drawings.

DETAILED DESCRIPTION

Figure 1A:
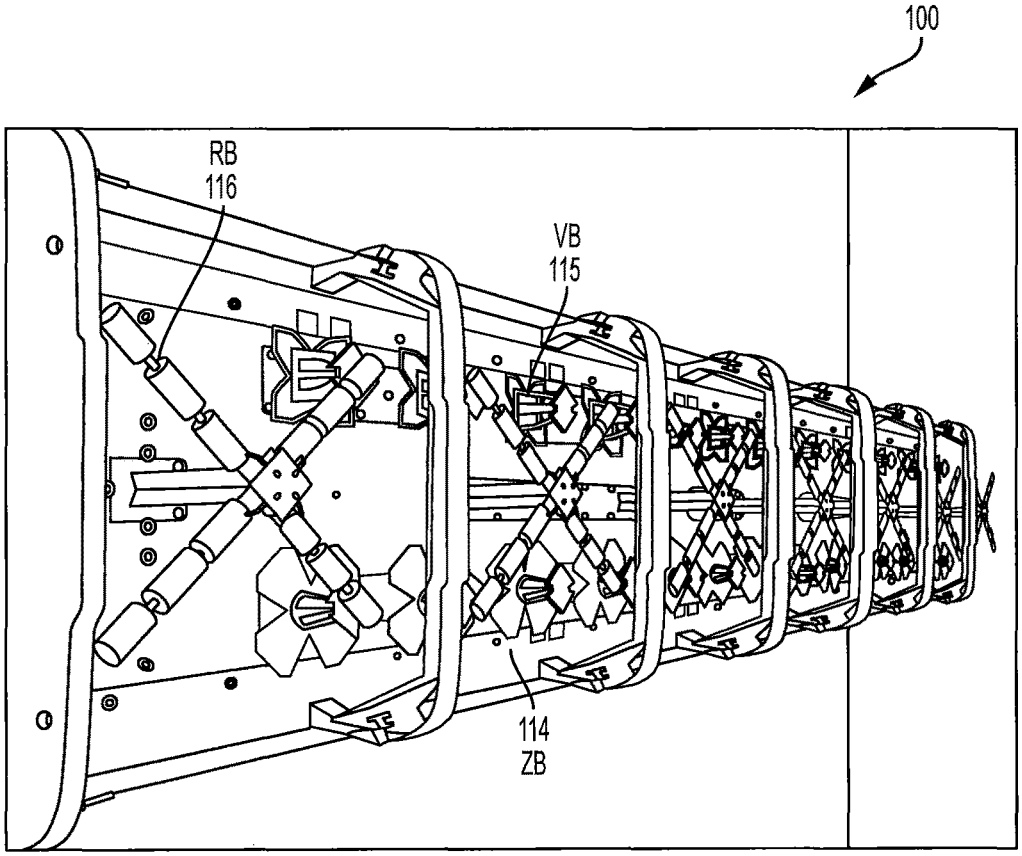
FIG. 1A is a photograph illustrating a multi-band antenna array according to some embodiments of the present disclosure.

Hereinafter, radiating elements (also referred to herein as antennas or radiators) of a multi-band radiating antenna array, such as a cellular base station antenna, are described. In the following description, numerous specific details, including particular horizontal beamwidths, air-interface standards, dipole arm segment shapes and materials, dielectric materials, and the like are set forth. However, from this disclosure, it will be apparent to those skilled in the art that modifications and/or substitutions may be made without departing from the scope and spirit of the invention. In other circumstances, specific details may be omitted so as not to obscure the invention.

As used hereinafter, "low-band" may refer to a lower operating frequency band for radiating elements described herein (e.g., 694-960 MHz), "high-band" may refer to a higher operating frequency band for radiating elements described herein (e.g., 1695 MHz-2690 MHz), and "wide band" may refer to an operating frequency band that may partially or fully overlap with the low-band and/or the high-band (e.g., 1427-2690 MHz). A "low-band radiator" may refer to a radiator for such a lower frequency band, a "high-band radiator" may refer to a radiator for such a higher frequency band, and an "ultra-wideband radiator" may refer to a radiator for such a wider frequency band. "Dual-band" or "multi-band" as used herein may refer to arrays including both low-band and high-band radiators. Characteristics of interest may include the beam width and shape and the return loss. In some embodiments described herein, an ultra-wideband radiating element can cover a frequency range of about 1400 MHz to about 2800 MHz, which, in combination with remaining radiating elements in the array, can cover almost the entire bandwidth assigned for all major cellular systems.

Embodiments described herein relate generally to ultra-wideband radiators of a dual- or multi-band cellular base station antenna and such dual- or multi-band cellular base-station antennas adapted to support emerging network technologies. Such dual- or multi-band antenna arrays can enable operators of cellular systems ("wireless operators") to use a single type of antenna covering a large number of bands, where multiple antennas were previously required. Such antennas are capable of supporting several major air-interface standards in almost all the assigned cellular frequency bands and allow wireless operators to reduce the number of antennas in their networks, lowering tower leasing costs while increasing speed to market capability.

Antenna arrays as described herein can support multiple frequency bands and technology standards. For example, wireless operators can deploy using a single antenna Long Term Evolution (LTE) network for wireless communications in the 2.6 GHz and 700 MHz bands, while supporting Wideband Code Division Multiple Access (W-CDMA) network in the 2.1 GHz band. For ease of description, the antenna array is considered to be aligned vertically. Embodiments described herein can utilize dual orthogonal polarizations and support multiple-input and multiple-output (MIMO) implementations for advanced capacity solutions. Embodiments described herein can support multiple air-interface technologies using multiple frequency bands presently and in the future as new standards and bands emerge in wireless technology evolution.

Embodiments described herein relate more specifically to antenna arrays with interspersed radiators for cellular base station use. In an interspersed design, the low-band radiators may be arranged or located on an equally-spaced grid appropriate to the frequency. The low-band radiators may be placed at intervals that are an integral number of high-band radiators intervals (often two such intervals), and the low-band radiators may occupy gaps between the high-band radiators. The high-band radiators may be dual-slant polarized and the low-band radiators may be dual polarized and may be either vertically and horizontally polarized, or dual slant polarized.

A challenge in the design of such dual- or multi-band antennas is reducing or minimizing the effects of scattering of the signal at one band by the radiating elements of the other band(s). Embodiments described herein can thus reduce or minimize the effect of the low-band radiators on the radiation from the high-band radiators, and vice versa. This scattering can affect the shapes of the high-band beam in both azimuth and elevation cuts and may vary greatly with frequency. In azimuth, typically the beamwidth, beam shape, pointing angle gain, and front-to-back ratio can all be affected and can vary with frequency, often in an undesirable way. Because of the periodicity in the array introduced by the low-band radiators, grating lobes (sometimes referred to as quantization lobes) may be introduced into the elevation pattern at angles corresponding to the periodicity. This may also vary with frequency and may reduce gain. With narrow band antennas, the effects of this scattering can be compensated to some extent in various ways, such as adjusting beamwidth by offsetting the high-band radiators in opposite directions or adding directors to the high-band radiators. Where wideband coverage is required, correcting these effects may be particularly difficult.

Some embodiments of the present disclosure may arise from realization that performance of antenna arrays including a column of low-band radiator elements (e.g., having an operating frequency range of about 694 MHz to about 960 MHz; also referred to herein as R-band or RB elements) between columns of high-band radiator elements (e.g., having an operating frequency range of about 1695 MHz to about 2690 MHz; also referred to herein as V-band or VB elements) may be improved by replacing one of the columns of VB elements with a column of ultra wideband radiator elements (e.g., having operating frequency range of about 1400 MHz to about 2700 MHz; also referred to herein as Z-band or ZB elements), with each column of radiators driven by a different feed. The inclusion of such ZB radiating elements, in combination with the VB radiating elements arranged on an opposite side of the RB radiating elements, may allow for greater performance over a wider operating frequency range, while also reducing costs and without a space penalty with respect to the size of the antenna array. Ultra wide band radiating elements and/or configurations as described herein may be implemented in multi-band antenna arrays in combination with antennas and/or features such as those described in commonly-assigned U.S. patent application Ser. No. 14/683,424 filed Apr. 10, 2015, U.S. patent application Ser. No. 14/358,763 filed May 16, 2014, and/or U.S. patent application Ser. No. 13/827,190 filed Mar. 14, 2013, the disclosures of which are incorporated by reference herein.

Figure 1B:
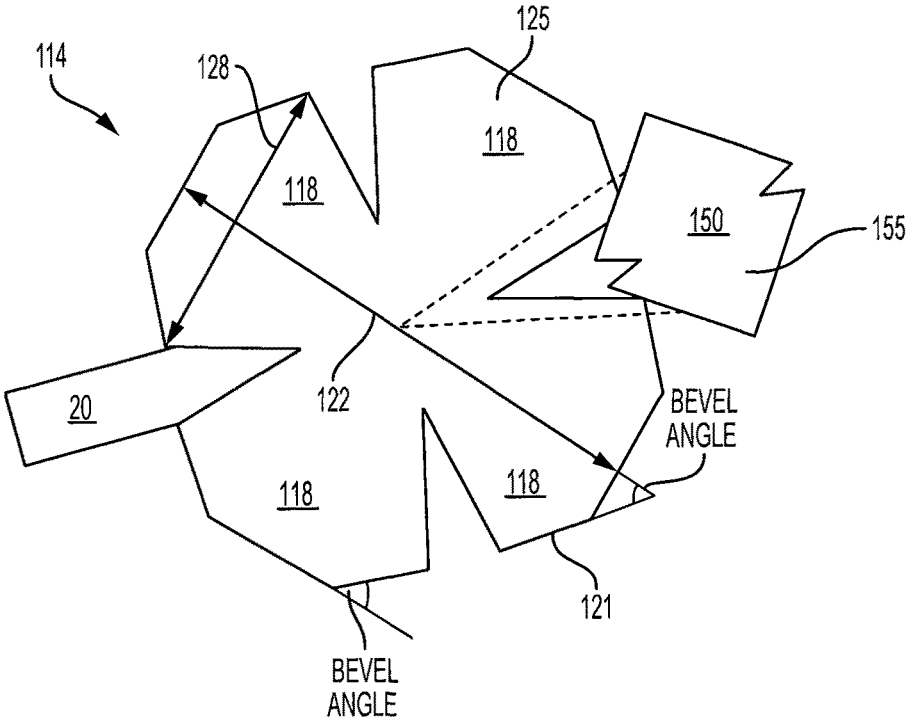
FIG. 1B illustrates a general structure of a wide-band (ZB) radiating element for wideband, mid to high-frequency operation that may be used in a multi-band antenna array according to some embodiments of the present disclosure.
Figure 1C:
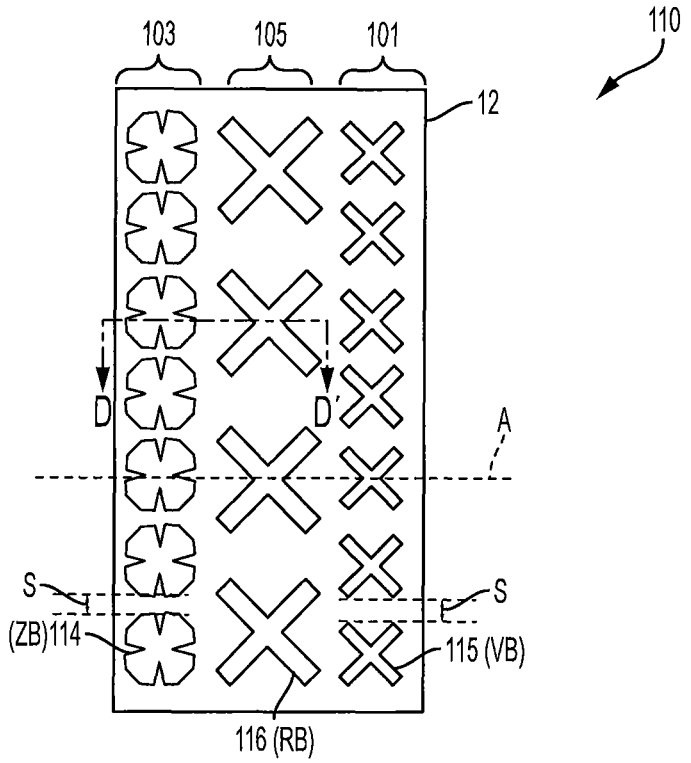
FIG. 1C illustrates a schematic plan view of a multi-band antenna array according to some embodiments of the present disclosure.

FIG. 1A illustrates a multi-band antenna array 110 according to some embodiments of the present disclosure, and FIG. 1C illustrates a layout of the multi-band antenna array 110 of FIG. 1A in plan view. As shown in FIGS. 1A and 1C, the multi-band antenna array includes a reflector 12 (e.g., a ground plane) on which low-band RB radiating elements 116 are arranged to define a column 105. The low-band RB radiating elements 116 are configured to operate at a low-band frequency range of about 694 to 960 MHz. The column 105 of RB radiating elements 116 is arranged between a column 101 of high-band VB radiating elements 115, which are configured to operate at a high-band frequency range of about 1.695 GHz to 2.690 GHz, and a column 103 of ultra wideband ZB radiating elements 114, which are configured to operate at a wideband frequency range of about 1.4 GHz to about 2.7 GHz, on the planar reflector 12.

In the embodiment shown in FIGS. 1A and 1C, the RB radiating elements 116 are low-band (LB) elements positioned with an inter-element spacing of about 265 mm between adjacent RB radiating elements in the column 105. The VB radiating elements 115 are high-band (HB) elements positioned with an inter-element spacing S of about 115 mm between adjacent VB radiating elements 115 in the column 101. The ZB radiating elements 114 are ultra wideband elements positioned with an inter-element spacing S of about 115 mm between adjacent ZB elements in the column 103. However, it will be understood that the array configuration and element spacings of FIGS. 1A and 1C are illustrated by way of example, and that embodiments of the present disclosure are not limited thereto. For example, in some embodiments, the vertical columns 101 and 105 of high-band elements 115 and low-band elements 116 may be spaced at about one-half wavelength to one wavelength intervals.

As shown in FIG. 1C, the radiating elements 114, 115, and/or 116 may be implemented as a pair of crossed dipoles. The crossed dipoles may be inclined at 45° so as to radiate slant polarization. The crossed dipoles may be implemented as bow-tie dipoles or other wideband dipoles. In particular, in the example radiating antenna array 110 of FIG. 1C, the lower band radiating elements 116 are implemented as cross dipole elements arranged in a vertical column 105 on reflector 12. Higher band radiating elements 115 and 114 are implemented as high impedance cross dipole elements and are arranged on the reflector 12 in a vertical column 101 and a vertical column 103, respectively, on opposite sides of the vertical column 105. As noted above, the low-band RB radiators 116 are configured to operate in the 694-960 MHz band, the high-band VB radiators 115 are configured to operate in the 1.7-2.7 GHz (1695-2690 MHz) band, and the ultra wideband ZB radiators 114 are configured to operate in the 1.4-2.7 GHz (1427-2695 MHz) band. The low-band RB radiators 116 may provide a 65 degree beamwidth with dual polarization in some embodiments. Such dual polarization may be required for base-station antennas. While specific configurations of dipoles are shown, other dipoles may be implemented using tubes or cylinders or as metalized traces on a printed circuit board, for example. Other types of radiating elements (e.g., patch radiators) may also be used.

Figure 1D:
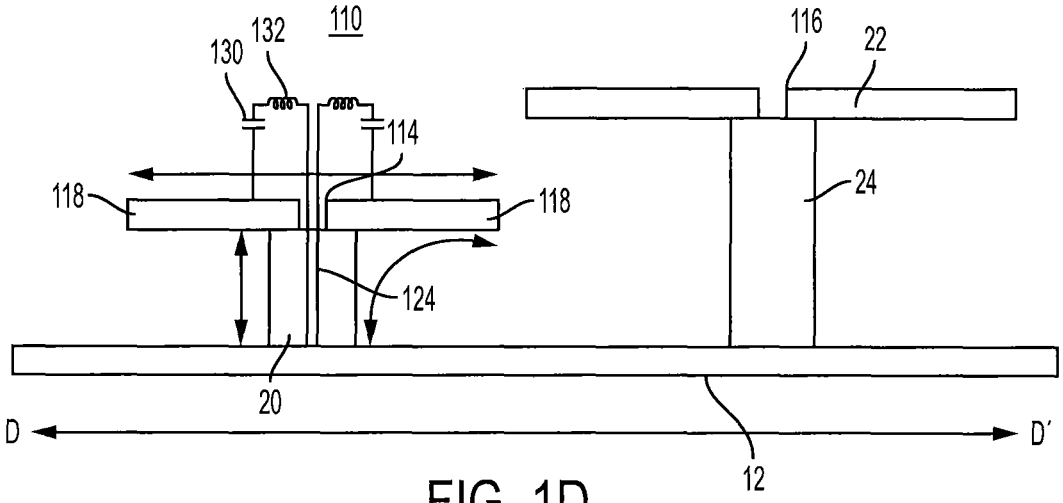
FIG. 1D is a schematic side view of the wide-band (ZB) and low-band (RB) radiating elements of a multi-band antenna array according to some embodiments of the present disclosure.

FIG. 1D is a side view relative to line D-D' of FIG. 1C that schematically illustrates an R-band (RB) element 116 and a Z-band (ZB) element 114 of the antenna array 110. As shown in FIG. 1D, the low-band RB radiating element 116 includes opposing arm segments 22 that define first and second dipole antennas. The arm segments 22 radially extend from a stalk defined by a feed board 24 that protrudes from the planar reflector or ground plane 12. In some embodiments, each dipole arm segment 22 may be approximately one-quarter wavelength long with respect to the low-band operating frequency to define first and second half-wave dipoles. In other embodiments, opposing arm segments 22 of the low-band RB radiating element 116 may define a first dipole and second, extended dipole configured in a crossed-dipole arrangement with crossed center feed. The dipole antennas may be connected to an antenna feed by a center feed provided by the feed board 24. Additionally, the feed board 24 may be approximately one-quarter wavelength long with respect to the low-band operating frequency. The ultra wideband ZB radiating element 114 includes opposing arm segments 118 that define a half-wave or full wave dipole, for example, with respect to the lower and upper bounds of the wideband operating frequency range. The arm segments 118 radially extend from a stalk defined by a feed board 20 that protrudes from a planar reflector or ground plane 12. Each dipole arm segment 118 may be approximately one-quarter to one-half wavelength long at the lower and upper bounds of the wideband operating frequency.

FIG. 1B illustrates the structure of the ultra wide band (ZB) radiating element in greater detail. As shown in FIGS. 1B and 1D, the ZB radiating element 114 includes a stalk 20 that suspends arm segments 118 above a mounting surface (e.g., a planar reflector or ground plane 12). The arm segments 118 radially extend from an end of the stalk 20, opposite to the planar reflector 12 such that respective surfaces 125 of the arm segments 118 are parallel to the planar reflector 12. The stalk 20 and/or the arm segments 118 may be defined by metal layers on a printed circuit board (PCB) in some embodiments. Portions of the stalk 20 and arm segments 118 may be implemented by a unitary member, e.g., a single piece PCB, in some embodiments. The stalk 20 may provide a center feed and may suspend the arm segments 118 above the reflector 12 by a length based on a desired operating frequency in some embodiments. For example, the stalk 20 may be approximately one-quarter wavelength long with respect to the operating frequency or frequency range.

Still referring to FIGS. 1B and 1D, opposing ones of the arm segments 118 define first and second dipole antennas having a wideband operating frequency range in a crossed dipole arrangement positioned at one end of the stalk 20. The stalk 20 may be a feed board including feed lines 124 that connect the first and second dipole antennas to an antenna feed. A cross-pole ratio (CPR) may define the amount of isolation between orthogonal polarizations of signals transmitted by each of the first and second dipole antennas.

As noted above, two opposing dipole arm segments 118 together define a length 122 of the dipole arm (referred to herein as arm length) between ends thereof. The arm length 122 defined by the combined structure of the opposing dipole arm segments 118 may be approximately one-half wavelength (or more) at the lower bound of the wideband operating frequency range of the ZB radiating element 114. Since the upper bound (e.g., 2.7 GHz) of the ultra wideband operating frequency range is approximately twice the lower bound (e.g., 1.4 GHz) of the ultra wideband operating frequency range, and wavelength is inversely proportional to frequency, the arm length 122 defined by the combined structure may also be approximately one-full wavelength (or less) at the upper bound of the wideband operating frequency range. That is, the respective arm lengths 122 may be between about one half wavelength or more and one full wavelength or less with respect to the lower and upper bounds, respectively, of the operating frequency range of the ZB radiating element 114. For example, the arm length 122 may be about 0.8 wavelength, e.g., approximately a full wave dipole (FWD), with respect to an upper bound of the wideband operating frequency range. Ultra wideband ZB radiating elements 114 in accordance with some embodiments of the present disclosure may thus combine benefits of a full-wave dipole and a half-wave dipole, with an equivalent arm length of about 0.5 to 1 wavelength at the lower and upper bounds, respectively, of the wideband operating frequency range.

As shown in FIG. 1B, each arm segment 118 may be relatively wide in a respective width direction 128 (referred to herein as arm width) that is perpendicular to the arm length 122. In some embodiments, the arm width 128 may be greater than about one-half of the arm length 122. The increased width 128 increases a surface area of the ZB radiating element 114, which may increase or widen the bandwidth. Opposing corners 121 on each end of the arm segments 118 may be beveled, chamfered, or otherwise cut or angled, increasing spacing (and thus reducing coupling) between adjacent ZB elements 114 in the column 103. For example, the beveled corners 121 may improve 2.6 GHz isolation (ISO) in some embodiments. However, the amount or angle of the cut/beveled corner 121 can reduce bandwidth. As such, the beveled or chamfered corner 121 may define an angle of less than about 70 degrees but greater than about 20 degrees relative to the respective arm length in some embodiments. Conversely, the beveled or chamfered corner 121 may define an angle of greater than about 20 degrees but less than about 70 degrees relative to an edge at an end of a respective arm segment 118.

Ultra wideband ZB radiating elements 114 in accordance with embodiments of the present disclosure may further include combinations of one or more additional features, as described below.

For example, in some embodiments, a director element 150 may protrude from an intersection between the beveled arm segments 118 defining the crossed dipole antennas. The director element 150 may include a surface 155 extending parallel to and suspended above the respective surfaces 125 of the arm segments 118, which may stabilize an azimuth beamwidth of the ZB radiating element 114. The presence of the director element 150 suspended above the crossed arm segments 118 may have a greater effect on azimuth beamwidth stabilization for the ultra wideband ZB radiating elements 114 than for the VB radiating elements 115 in some embodiments.

In addition, in some embodiments, a serially connected inductor 132 and capacitor 130 may be used to couple the beveled arm segments 118 to the stalk 20, in an arrangement similar to that described in U.S. patent application Ser. No. 13/827,190, the disclosure of which is incorporated by reference herein. In particular, as illustrated in FIG. 1D, to tune the CM frequency up and out of the lower band, the dipole arms 118 of the ZB radiating elements 114 may be capacitively coupled to the feed lines on the feed board 20 by respective capacitors 130. The feed board 20 may include a hook balun to transform an input RF signal from single-ended to balanced, and feed lines to propagate the balanced signals up to the radiators. The capacitor elements 130 may provide coupling to the dipole arm segments 118, and inductor elements 132 couple the feed lines to the capacitor elements 130. The capacitors 130 may act as an open circuit at lower band frequencies. In some embodiments, each structure 118, 20 may be (independently) smaller than one-quarter wavelength at low-band frequencies. Thus, CM resonance may be moved up and out of the low-band.

However, the inductors 132 coupled with feed lines 124 may extend the overall length of the monopole formed by the structures 118, 20, which may produce an undesirable common mode resonance in the low-band. As such, in some embodiments, an additional capacitor may be serially connected between the inductors 132 and the feed lines 124 to improve rejection of such common mode resonance (i.e., a CLC matching section instead of the LC matching section shown in FIG. 1D). This additional capacitor can help block some of the low-band currents from reaching the inductors 132, which may reduce the effective length of the monopole formed by the segments 118, 20 in the lower frequency band and may therefore push the CM resonance frequency higher than the low-band frequency range. Thus, respective combinations of the feed board 20 and the arm segments 118 may not resonate in the low-band frequency range by using a high-impedance radiating element 114, with respect to either a single dipole or both dipoles in the crossed dipole configuration.

Furthermore, in some embodiments, the ZB elements 114 including beveled arm segments 118 may be positioned with respective centers or stalks 20 thereof aligned along the vertical direction of the column 103, with respective spacings between immediately adjacent radiating elements 114 selected based on a trade-off between the 1.4 GHz band azimuth pattern squint and the 2.6 GHz band elevation pattern grating lobe, as discussed in greater detail below with reference to the graphs of FIGS. 2A-7C. For example, insufficient spacing between immediately adjacent ones of the radiating elements 114 may cause squint problems (i.e., with respect to the angle by which transmission is offset from a normal of the plane of the antenna array), which can be addressed by enlarging the spacing S between the immediately adjacent radiating elements 114. In some embodiments, the inter-element spacing S may be about 115 mm. However, in other embodiments, the ZB elements 114 may not be vertically aligned in the column 103, but rather, may define a 'loose' column including ZB elements 114 arranged in a staggered pattern.

In addition, in some embodiments, the spacing between the VB radiating elements 115 in column 101 may be the same as the spacing between the beveled-arm ZB radiating elements 114 in column 103, such that the stalks of the VB radiating elements 115 and the ZB radiating elements 114 are horizontally or laterally aligned (along line A) to define respective rows. As such, in some embodiments the respective rows (each including a VB radiating element 115 and a ZB radiating element 114) may be spaced apart by about 115 mm. In other words, the respective elements 115, 114 of the two high-band arrays (i.e., the VB 1.7-2.7 GHz array 101 and the ZB 1.4-2.7 GHz array 103) may be horizontally aligned in rows to improve patterns for both arrays 101 and 103. As discussed with reference to the data below, performance of the radiating array 110 may also be increased with respect to the front to back ratio, despite the positioning of the ZB elements 114 close to the edge of the reflector 12, due to less than expected leakage from the front to the back of the array 110.

FIGS. 2A-7C are graphs illustrating various characteristics of a conventional multi-band antenna array including a column of RB radiating elements between columns of VB radiating elements (referred to below as the VB array for convenience), as compared to a multi-band antenna array according to embodiments of the present disclosure including a column of RB radiating elements between a column of VB radiating elements and a column of ZB radiating elements (referred to below as the ZB array for convenience). The ZB array may have a layout similar to the arrangement shown in FIG. 1C. The graphs of FIGS. 2A-6C illustrate effects of inter-element spacing in each column (in particular, 106 mm spacing vs. 121 mm spacing vs. 115 mm spacing), as well as the effects of different inter-element spacings in different columns. In the graphs of FIGS. 2A-6C, the six different colors shown represent results for two ports (VB and ZB) of the arrays, at three different down tilts (relative to elevation of the array with respect to the horizon).

Figure 2B:
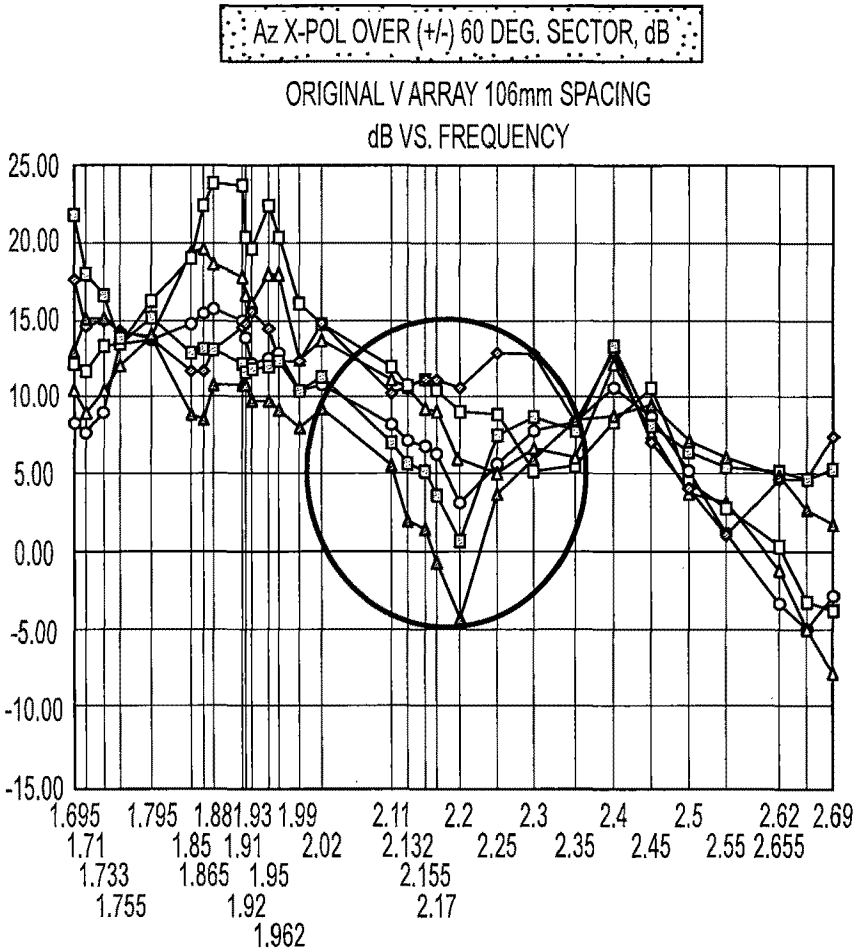
FIGS. 2A and 2B are graphs illustrating azimuth beam peak angle vs. frequency and azimuth beam cross-polarization vs. frequency, respectively, for a multi-band antenna array including columns of high-band (VB) radiating elements with inter-element spacing of about 106 mm.
Figure 2A:
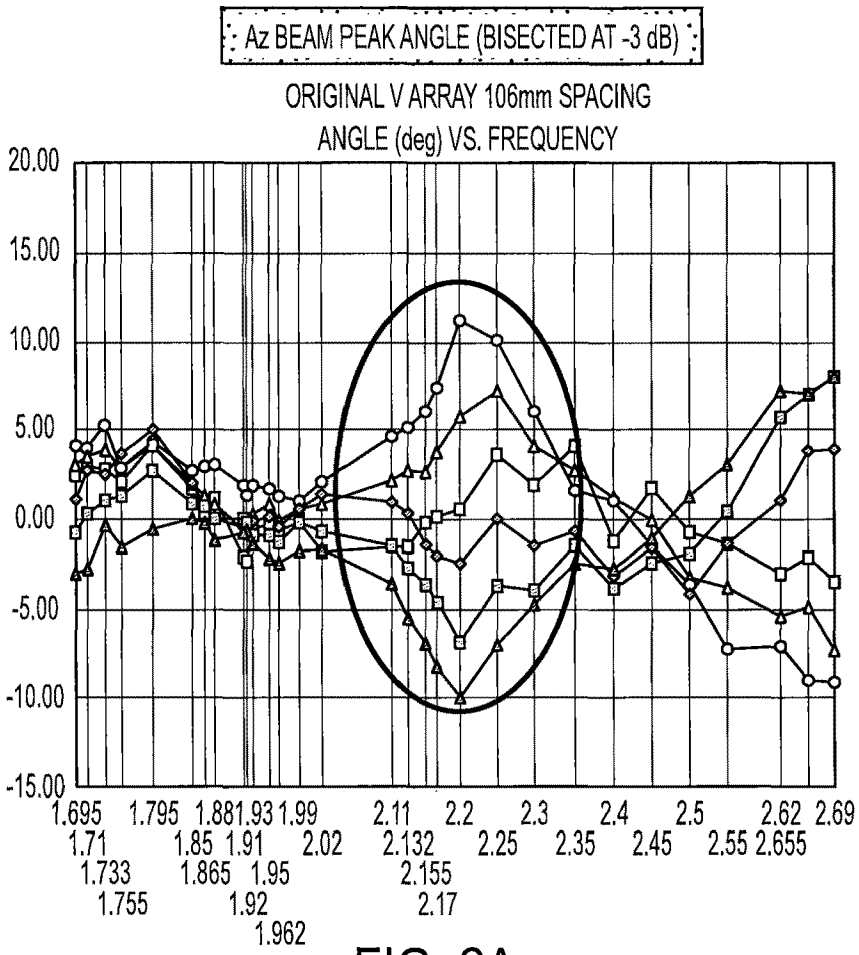
Figure 3A:
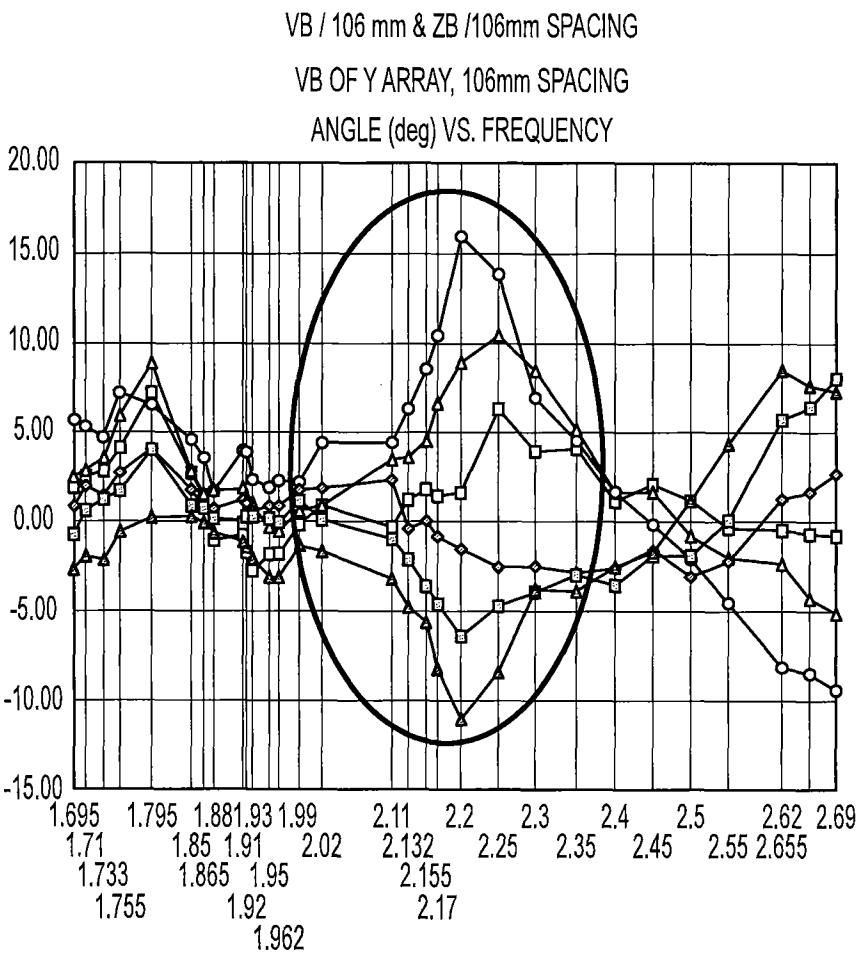
FIGS. 3A, 3B, and 3C are graphs illustrating azimuth beam peak angle vs. frequency, azimuth beam cross-polarization vs. frequency, and azimuth beamwidth vs. frequency, respectively, for a multi-band antenna array including a column of high-band (VB) radiating elements (with inter-element spacing of about 106 mm) and a column of wide-band (ZB) radiating elements (with inter-element spacing of about 106 mm) according to some embodiments of the present disclosure.
Figure 3B:
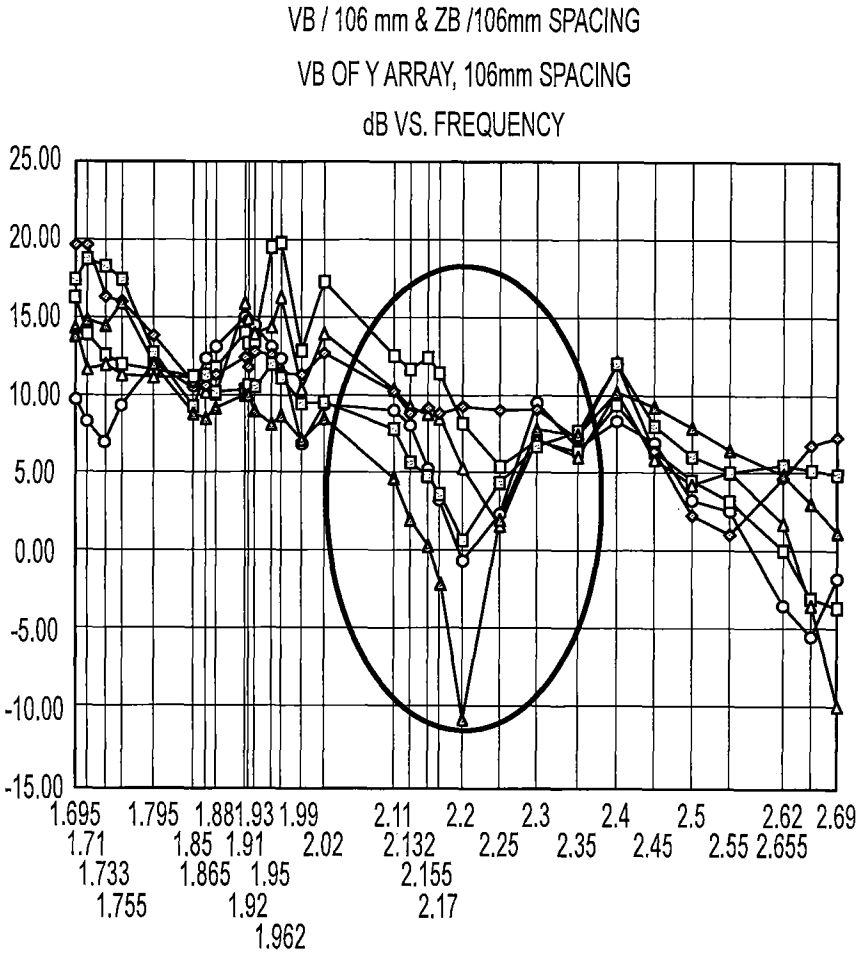

FIGS. 2A and 3A illustrate azimuth beam peak angle vs. frequency characteristics for the VB array (with inter-element spacing of about 106 mm in each VB radiating element column) and for the ZB array (with the same inter-element spacing of about 106 mm in both the VB and ZB radiating element columns), respectively. FIGS. 2B and 3B illustrate azimuth beam cross-polarization, in decibels (dB), vs. frequency characteristics for the VB array (with inter-element spacing of about 106 mm in each VB radiating element column) and for the ZB array (with the same inter-element spacing of about 106 mm in both the VB and ZB radiating element columns), respectively. The cross polarization (X-pol) may be specified for an antenna as a power level, in negative dB, indicating how many dB the X-pol power level is below the desired polarization's power level. As shown in FIGS. 2A-3A and 2B-3B, both the VB array and the ZB array exhibit resonance at squint and cross pole ratio (CPR) due to strong coupling. For example, the ZB radiating element arm segments may be too big, causing a similar phenomenon as a low-band full-wave dipole (FWD).

Figure 4A:
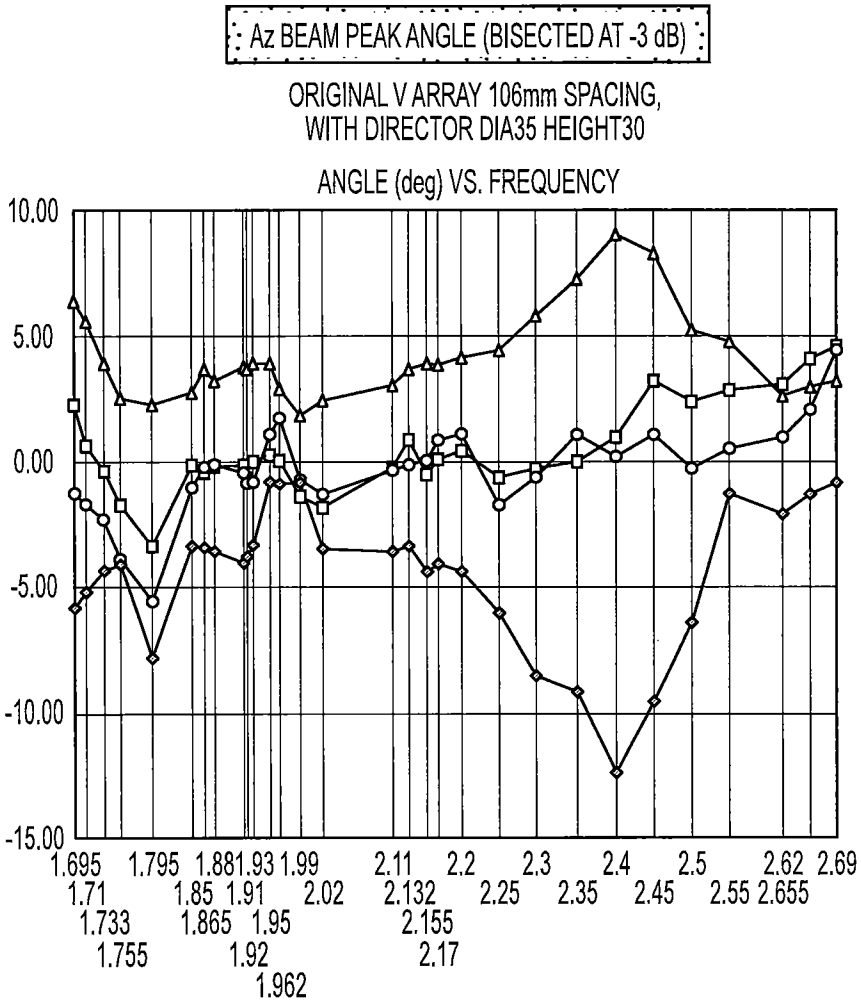
FIGS. 4A and 4B are graphs illustrating azimuth beam peak angle vs. frequency and azimuth beam cross-polarization vs. frequency, respectively, for a multi-band antenna array including columns of high-band (VB) radiating elements with inter-element spacing of about 106 mm, with each high-band (VB) radiating element including a respective director element.
Figure 5A:
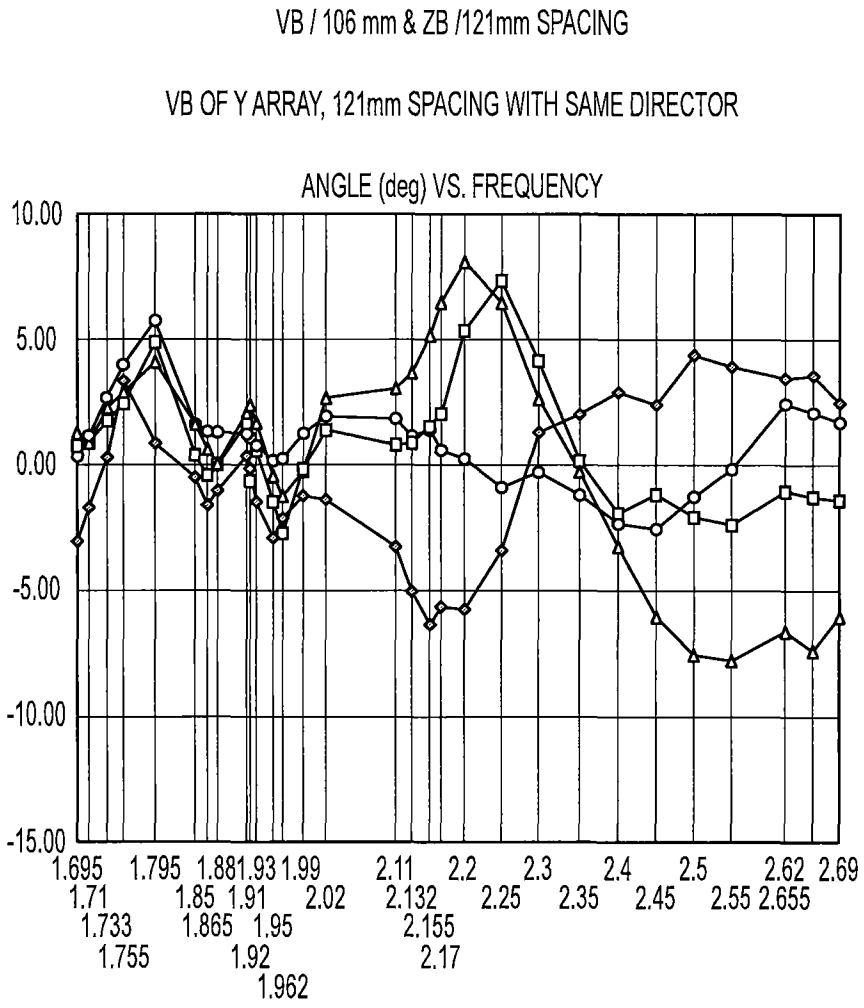
FIGS. 5A, 5B, and 5C are graphs illustrating azimuth beam peak angle vs. frequency, azimuth beam cross-polarization vs. frequency, and azimuth beamwidth vs. frequency, respectively, for a multi-band antenna array including a column of high-band (VB) radiating elements (with inter-element spacing of about 106 mm) and a column of wide-band (ZB) radiating elements (with inter-element spacing of about 121 mm), with each VB and ZB radiating element including a respective director element, according to some embodiments of the present disclosure.
Figure 4B:
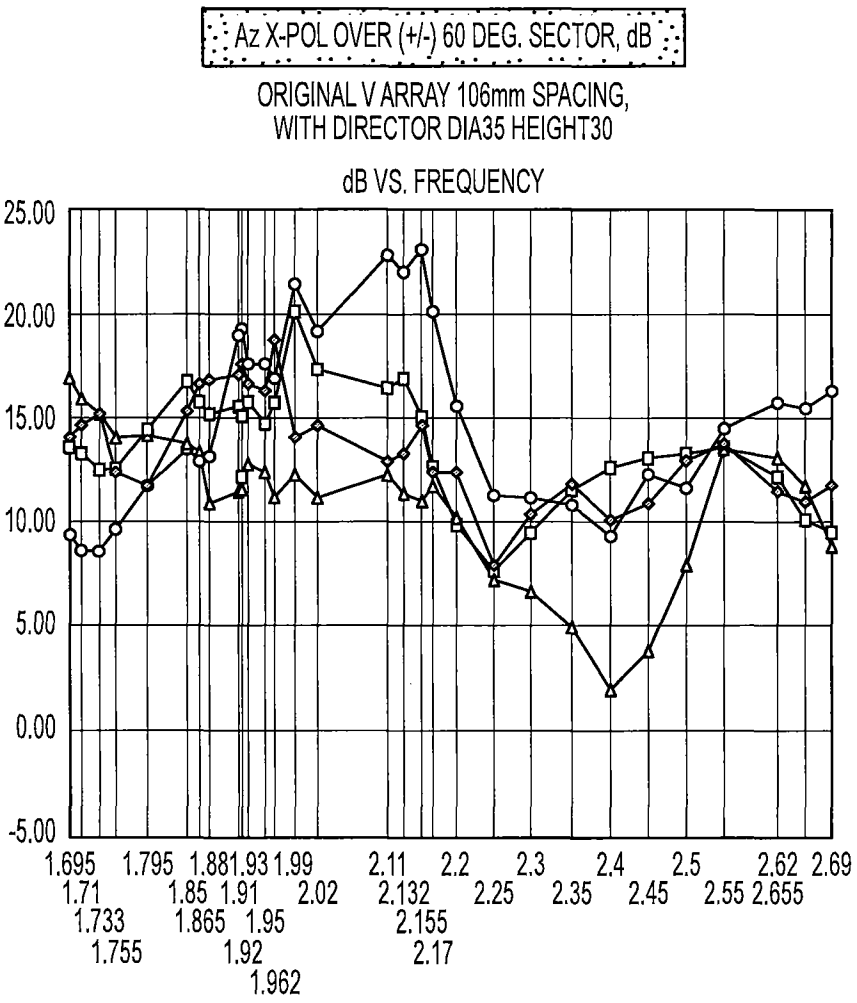

FIGS. 4A and 5A illustrate azimuth beam peak angle vs. frequency for the VB array (with inter-element spacing of about 106 mm in each VB radiating element column) and for the ZB array (with inter-element spacing of about 106 mm in the VB radiating element column, but with inter-element spacing of about 121 mm in the ZB radiating element column), respectively. FIGS. 4B and 5B illustrate azimuth beam cross-polarization, in decibels (dB), vs. frequency for the VB array (with inter-element spacing of about 106 mm in each VB radiating element column) and for the ZB array (with inter-element spacing of about 106 mm in the VB radiating element column, but with inter-element spacing of about 121 mm in the ZB radiating element column), respectively. That is, in FIGS. 4A-5B, the inter-element spacing in the VB and ZB radiating element columns differ (also referred to herein as mixed spacings). In addition, in FIGS. 4A-5B, each of the VB and ZB radiating elements includes a director element having a diameter (or other dimension, depending on the shape) of about 35 mm. The director element is suspended above each of the VB and ZB radiating elements by about 30 mm. As shown in FIGS. 4A-5B, the VB array and ZB array resonance at squint and CPR may be improved due to the larger spacing between the ZB radiating elements.

Figure 3C:
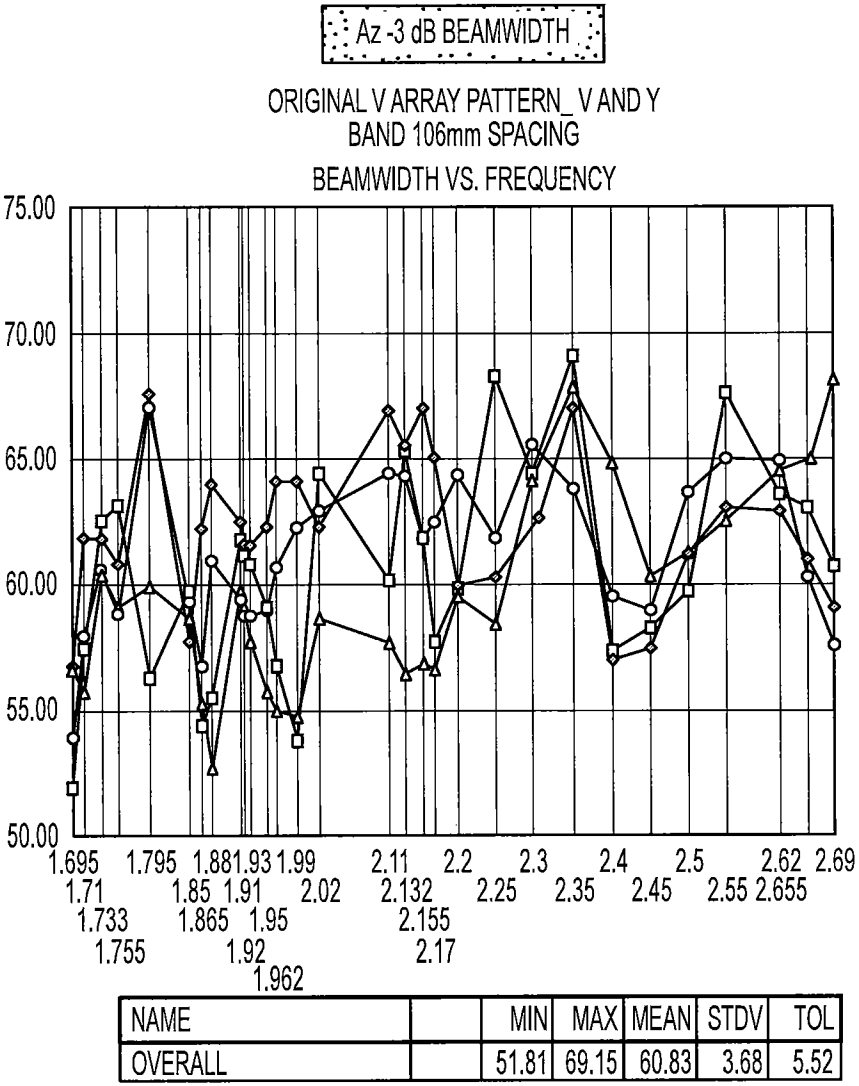
Figure 5C:
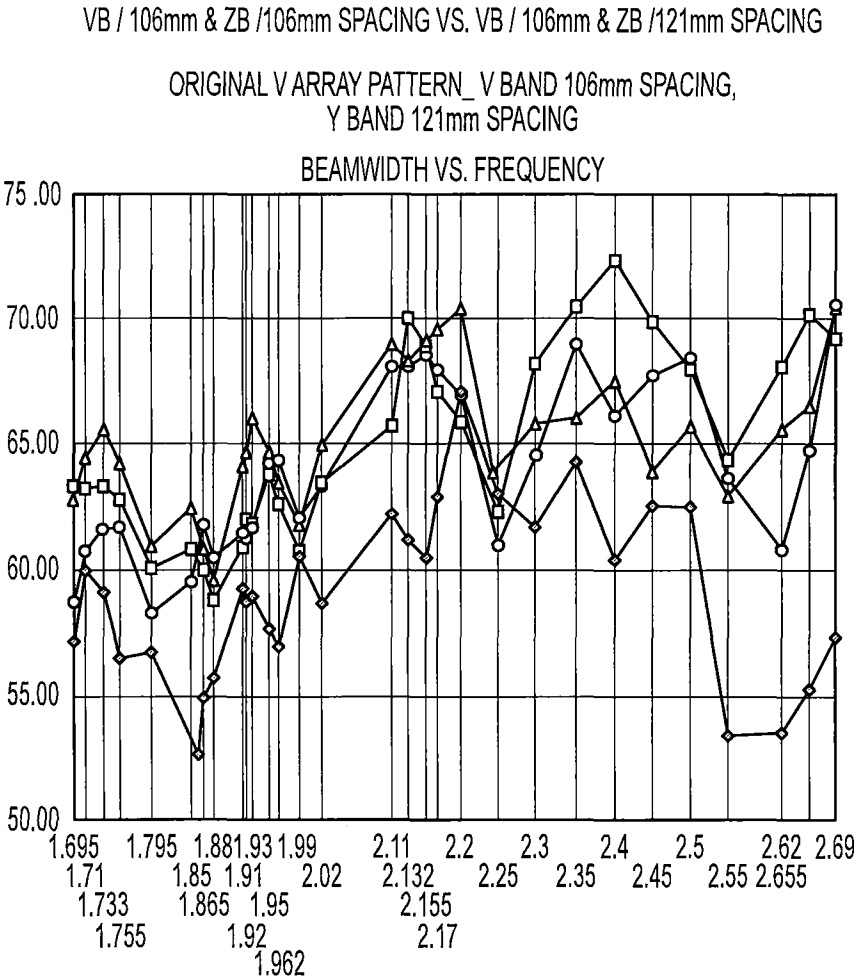
Figure 5B:
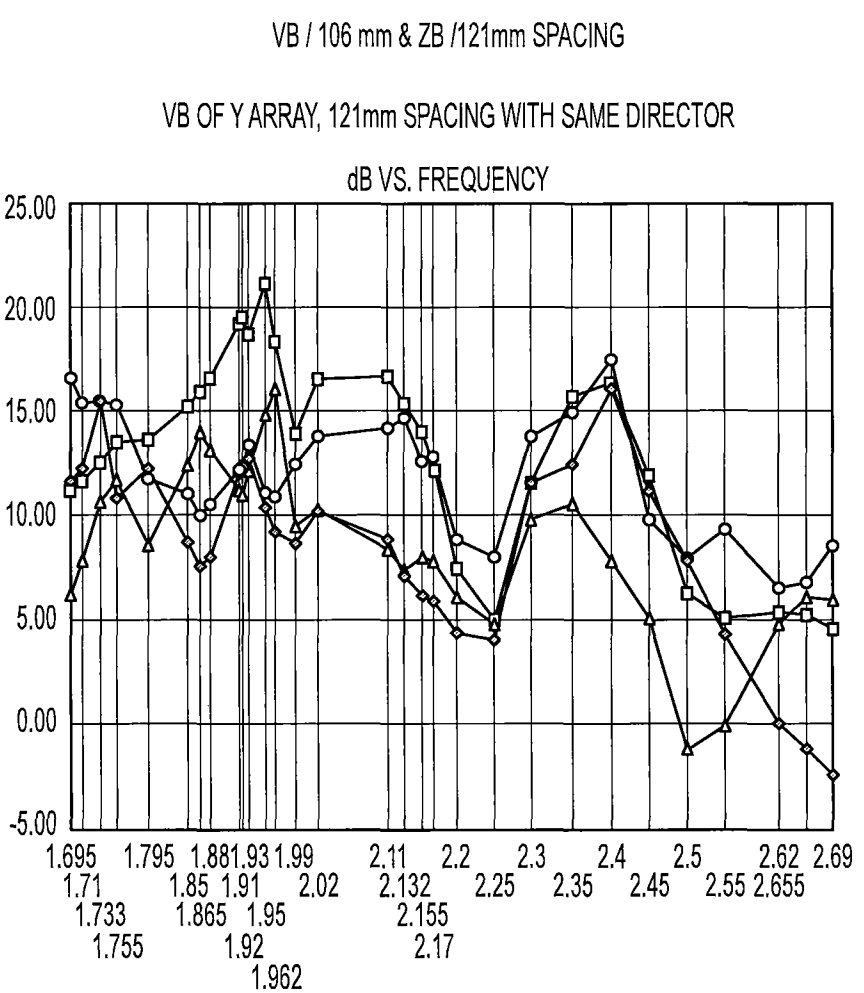

FIGS. 3C and 5C illustrate azimuth half-power (−3 dB) beamwidth vs. frequency for the ZB array with the same inter-element spacing in both the VB and ZB radiating element columns (of about 106 mm) and for the ZB array with different inter-element spacings in the VB radiating element column (of about 106 mm) and the ZB radiating element column (of about 121 mm), respectively. As shown in FIGS. 3C and 5C, the misalignment (e.g., along the horizontal direction) between the respective radiating elements of the VB and ZB radiating element columns (due to the different inter-element spacing in the vertical direction) appears to impact the azimuth beam pattern of the VB radiating elements (in particular the azimuth beamwidth, as shown in FIG. 5C). In addition, the larger spacing between the ZB radiating elements appears to result in a grating lobe at about 2690 MHz. As such, while squint may be improved by the larger inter-element spacing between the ZB radiating elements, performance of the VB radiating elements may be degraded due to lack of alignment relative to the respective ZB radiating elements in the horizontal direction.

Figure 6A:
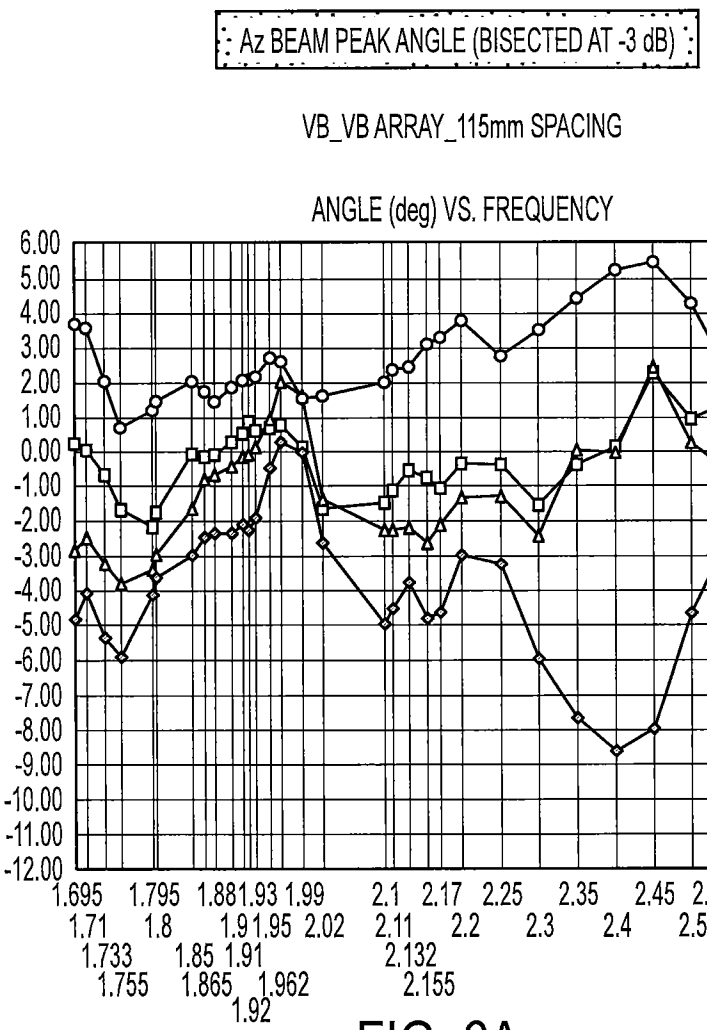
FIGS. 6A, 6B, and 6C are graphs illustrating azimuth beam peak angle vs. frequency, azimuth beam cross-polarization vs. frequency, and azimuth beamwidth vs. frequency, respectively, for a multi-band antenna array including columns of high-band (VB) radiating elements with inter-element spacing of about 115 mm.
Figure 6B:
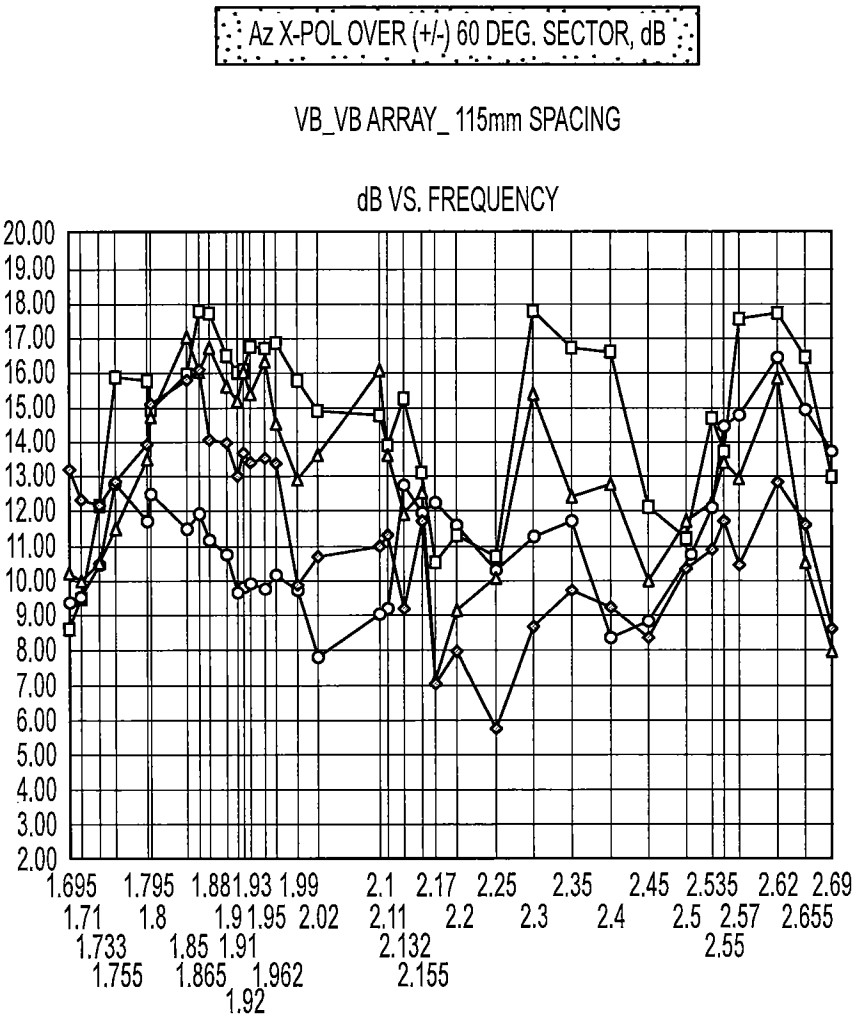
Figure 7A:
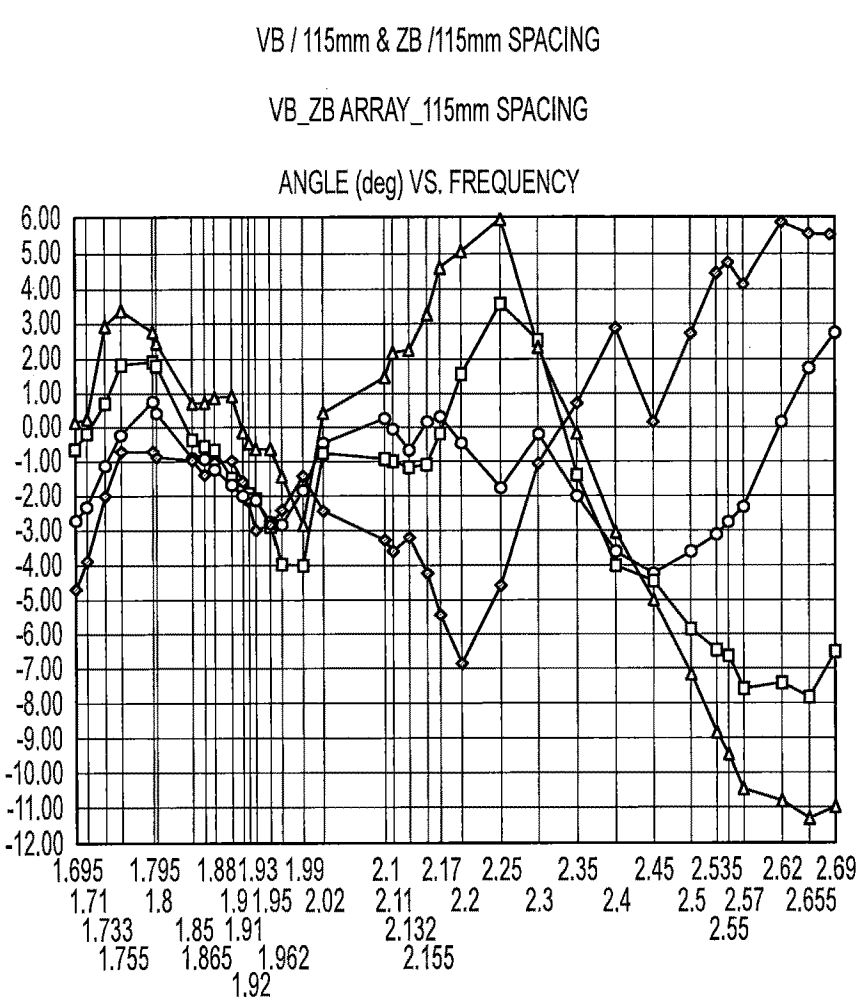
FIGS. 7A, 7B, and 7C are graphs illustrating azimuth beam peak angle vs. frequency, azimuth beam cross-polarization vs. frequency, and azimuth beamwidth vs. frequency, respectively, for a multi-band antenna array including a column of high-band (VB) radiating elements with inter-element spacing of about 115 mm and a column of wide-band (ZB) radiating elements with inter-element spacing of about 115 mm, according to some embodiments of the present disclosure.

FIGS. 6A and 7A illustrate azimuth beam peak angle vs. frequency for the VB array (with inter-element spacing of about 115 mm in each VB radiating element column) and for the ZB array (with the same inter-element spacing of about 115 mm in both the VB and ZB radiating element columns), respectively. FIGS. 6B and 7B illustrate azimuth beam cross-polarization, in decibels (dB), vs. frequency for the VB array (with inter-element spacing of about 115 mm in each VB radiating element column) and for the ZB array (with the same inter-element spacing of about 115 mm in both the VB and ZB radiating element columns), respectively. As shown in FIGS. 6A-7A and 6B-7B, the horizontal alignment of the VB and ZB radiating elements in each column appears to improve trade-offs between squint, CPR, and grating lobes. Each of the VB and ZB radiating elements may include a director element having a diameter (or other dimension, depending on the shape) of about 20 mm to about 50 mm, and the VB array and the ZB array may use different (e.g., with respect to size and/or shape) director elements. Other parameters may also benefit due to the horizontal alignment of the VB and ZB radiating elements to define respective rows.

Figure 6C:
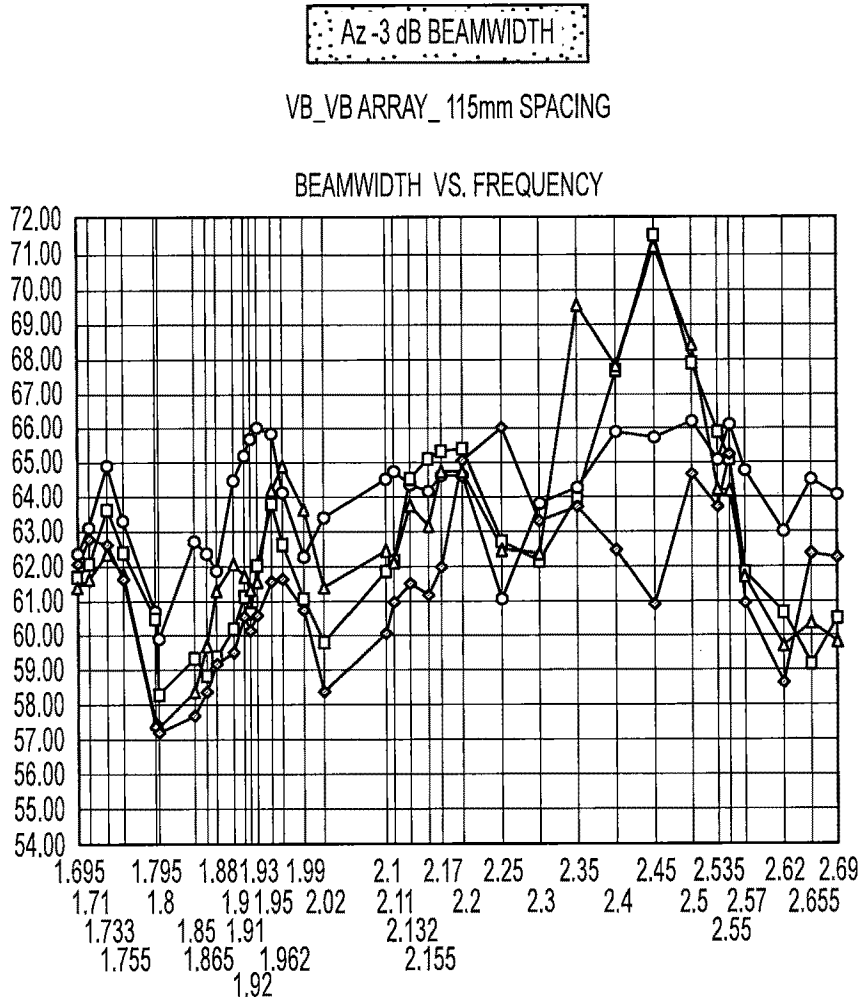
Figure 7B:
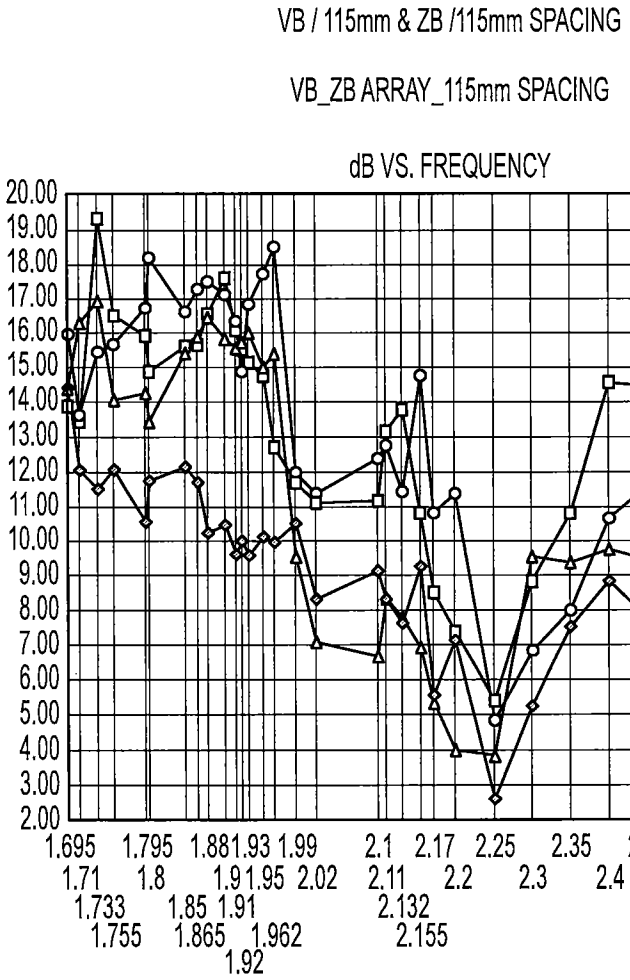
Figure 7C:
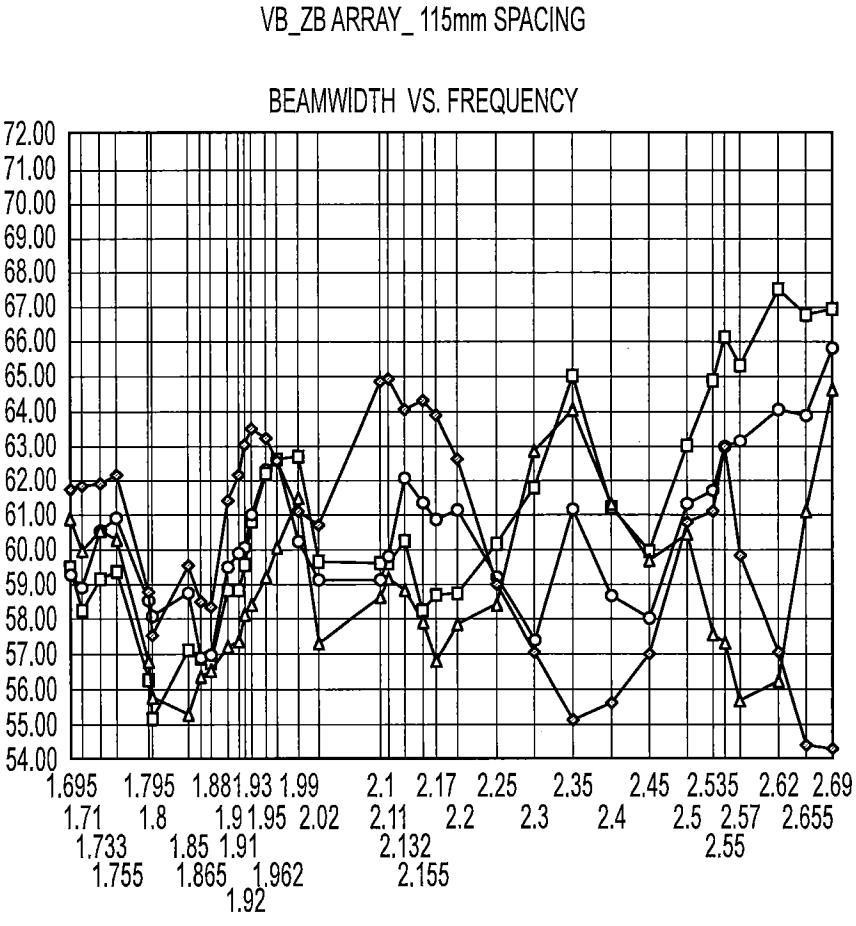

FIGS. 6C and 7C illustrate azimuth half-power (−3 dB) beamwidth vs. frequency for the VB array (with inter-element spacing of about 115 mm in each VB radiating element column) and for the ZB array (with the same inter-element spacing of about 115 mm in both the VB and ZB radiating element columns), respectively. Based on the measurements shown in FIGS. 6C and 7C, the 115 mm inter-element spacing, in combination with the horizontal alignment of the VB and ZB radiating elements in each column, appears to improve the trade-off between the 1.4 GHz band azimuth pattern squint and the 2.6 GHz band elevation pattern grating lobe. In particular, as shown in FIGS. 6C and 7C, the azimuth half-power beamwidth may be controlled from about 55° to about 70° over the entire operating frequency range, with respect to both the column of ZB elements and the column of VB elements.

Figure 9:
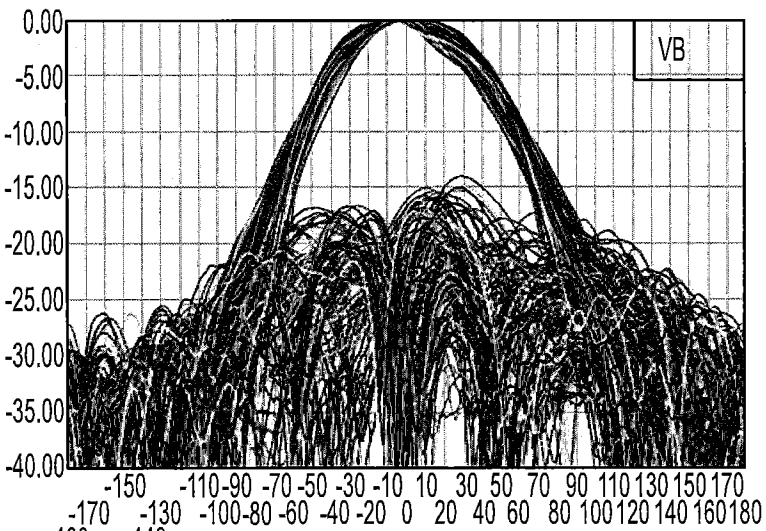
FIGS. 8-11 are graphs illustrating azimuth beamwidth performance (in degrees) for a multi-band antenna array including a column of high-band (VB) radiating elements and a column of wide-band (ZB) radiating elements, with inter-element spacing of about 115 mm in each column, for various operating frequency ranges according to some embodiments of the present disclosure.
Figure 8:
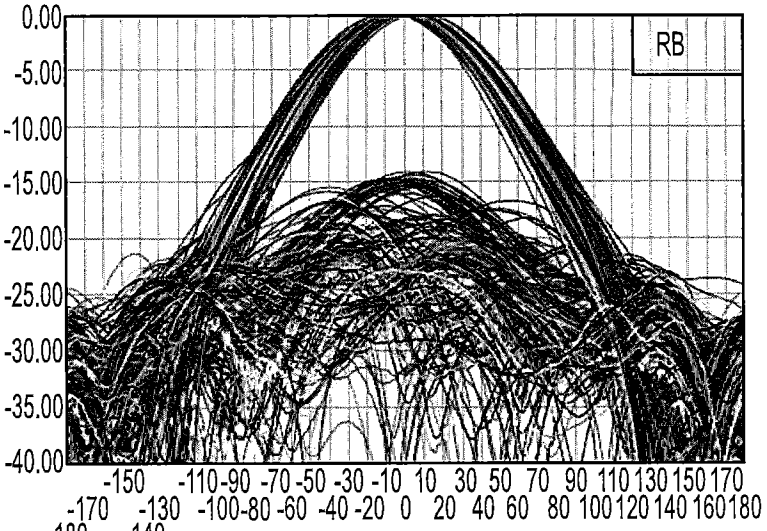
Figure 11:
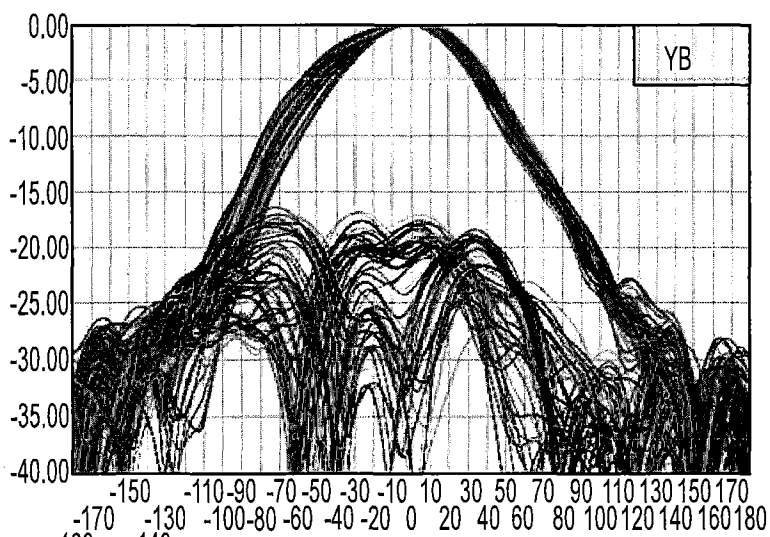
Figure 10:
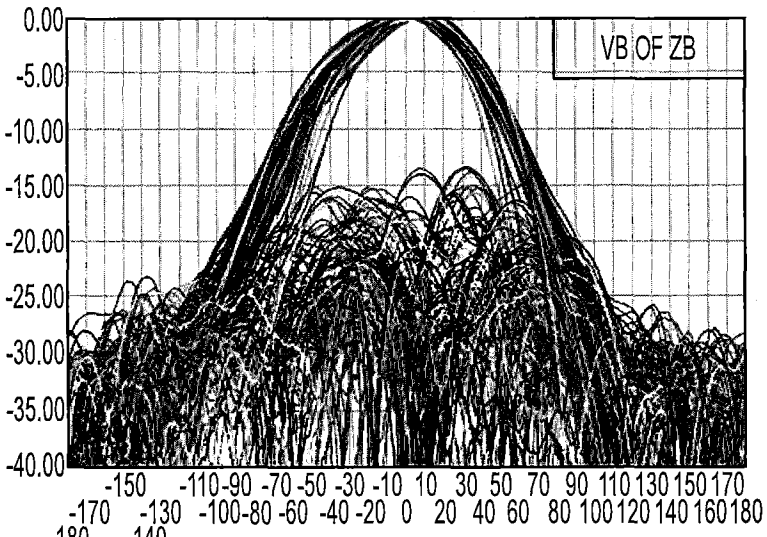

FIGS. 8-11 are graphs illustrating azimuth beamwidth performance (in degrees) for a multi-band antenna array according to embodiments of the present disclosure including a column of V-band (VB) radiating elements and a column of Z-band (ZB) radiating elements, with a column of R-band (RB) radiating elements therebetween, similar to the arrangement of FIG. 1C. In particular, FIG. 8 illustrates azimuth beamwidth patterns of the multi-band antenna array at the lower operating frequency band RB (e.g., 694-960 MHz); FIG. 9 illustrates azimuth beamwidth patterns of the multi-band antenna array at the higher operating frequency band VB (e.g., 1695 MHz-2690 MHz); FIG. 10 illustrates azimuth beamwidth patterns of the column of Z-band (ZB) radiating elements at the higher operating frequency band VB (e.g., 1695 MHz-2690 MHz); and FIG. 11 illustrates azimuth beamwidth patterns of the multi-band antenna array at a mid-operating frequency range (e.g., 1427 MHz-1511 MHz). In FIGS. 8-11, the X-axis represents the azimuth angle and the Y axis represents the normalized power level. The ZB radiating elements are arranged in a column with 115 mm inter-element spacing, and the VB radiating elements are arranged in a column with 115 mm inter-element spacing, such that pairs of VB and ZB radiating elements are horizontally aligned in rows. As shown in FIGS. 8-11, embodiments described herein can achieve a reasonable tradeoff between ZB and VB squint, cross polarization ratio, and grating lobe. Also, beamwidth may benefit from the alignment, and the lower operating frequency band (RB) pattern performance may be acceptable or improved.

Thus, according to some embodiments of the present disclosure, a column of low-band RB radiating elements may be arranged between column of high-band VB radiating elements and a column of ultra-wideband ZB radiating elements, to improve performance over a wider operating frequency range. In particular, embodiments of the present disclosure may include one or more of the following features, alone or in combination:

The arm segments of the ZB radiating elements may have increased width to improve wide band performance.

The stalk may include serially connected inductor(s) and capacitor(s).

A director may be arranged above the arm segments of the ZB radiating elements to stabilize the azimuth beamwidth.

An inter-element spacing of about 115 mm between adjacent ZB elements in a column may help with the trade-off between the 1.4 GHz band azimuth pattern squint and 2.6 GHz band elevation pattern grating lobe.

The respective elements of the two high band arrays (i.e., the 1.7~2.7 GHz array defined by the column of VB elements and the 1.4~2.7 GHz array defined by the column of ZB elements) may be horizontally or laterally aligned to improve pattern.

Corners of the arm segments of the ZB radiating element may be cut or beveled or chamfered to reduce coupling between adjacent elements, to improve 2.6 GHz ISO.

Embodiments of the present disclosure have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

Unless otherwise defined, all technical and scientific terms used herein have the same meaning as commonly understood by one of ordinary skill in the art to which this invention belongs. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Aspects and elements of all of the embodiments disclosed above can be combined in any way and/or combination with aspects or elements of other embodiments to provide a plurality of additional embodiments.

In the drawings and specification, there have been disclosed typical embodiments of the invention and, although specific terms are employed, they are used in a generic and descriptive sense only and not for purposes of limitation, the scope of the invention being set forth in the following claims.

That which is claimed:

1. A radiating element, comprising:

a plurality of arm segments defining at least one dipole antenna having a desired operating frequency range, wherein opposing ones of the arm segments define respective arm lengths that are about one-half wavelength or more with respect to a lower bound of the desired operating frequency range, and are about one full wavelength or less with respect to an upper bound of the desired operating frequency range; and a stalk configured to suspend the arm segments above a planar reflector such that respective surfaces of the arm segments radially extend from an end of the stalk and parallel to the planar reflector, wherein corners of the respective surfaces of the arm segments are beveled.

2. The radiating element of claim 1, wherein the at least one dipole antenna comprises first and second dipole antennas defined by opposing ones of the arm segments in a cross dipole arrangement.

3. The radiating element of claim 1, wherein the respective arm lengths are about 0.8 of the full wavelength with respect to the upper bound of the desired operating frequency range.

4. The radiating element of claim 1, wherein the corners of the respective surfaces of the arm segments are beveled at an angle of less than about 70 degrees but greater than about 20 degrees relative to the respective arm lengths.

5. The radiating element of claim 2, wherein the first and second dipole antennas have respective arm widths that are perpendicular to the respective arm lengths thereof, wherein the respective arm widths are greater than about one-half of the respective arm lengths.

6. The radiating element of claim 1, further comprising:

a director element protruding from an intersection between the arm segments at the end of the stalk, the director element comprising a surface extending parallel to the respective surfaces of the arm segments and suspended thereabove.

7. The radiating element of claim 2, wherein the radiating element comprises a plurality of radiating elements respectively comprising the first and second dipole antennas in the cross dipole arrangement, wherein the radiating elements are aligned in a column to define an array.

8. The radiating element of claim 7, wherein an inter-element spacing between adjacent ones of the radiating elements in the column is about 115 millimeters (mm).

9. The radiating element of claim 7, wherein the plurality of radiating elements are first radiating elements, and wherein respective stalks of the first radiating elements are laterally aligned with respective stalks of second radiating elements of a second column to define respective rows of the array.

10. The radiating element of claim 9, wherein the first radiating elements have respective shapes that differ from those of the second radiating elements.

11. The radiating element of claim 9, wherein a second operating frequency range of the second radiating elements is narrower than the desired operating frequency range of the first radiating elements.

12. The radiating element of claim 11, wherein the second operating frequency range overlaps with the desired operating frequency range.

13. The radiating element of claim 11, wherein the desired operating frequency range is about 1.4 GHz to about 2.7 GHz, and wherein the second operating frequency range is about 1.7 GHz to about 2.7 GHz.

14. The radiating element of claim 1, wherein the stalk comprises a feed board including feed lines that are configured to couple the arm segments to an antenna feed, and further comprising a serially connected inductor and capacitor coupling respective ones of the arm segments to the stalk.

15. The radiating element of claim 1, wherein the desired operating frequency range is about 1.4 GHz to about 2.7 GHz.

16. A radiating element, comprising:

a plurality of arm segments defining at least one dipole antenna having a desired operating frequency range, wherein opposing ones of the arm segments define respective arm lengths that are about one-half wavelength or more with respect to a lower bound of the desired operating frequency range, and are about one full wavelength or less with respect to an upper bound of the desired operating frequency range; and a stalk configured to suspend the arm segments above a planar reflector such that respective surfaces of the arm segments radially extend from an end of the stalk and parallel to the planar reflector, wherein corners of the respective surfaces of the arm segments are beveled at an angle of less than about 70 degrees but greater than about 20 degrees relative to the respective arm lengths.

17. The radiating element of claim 16, wherein the at least one dipole antenna comprises first and second dipole antennas defined by opposing ones of the arm segments in a cross dipole arrangement.

18. The radiating element of claim 17, wherein the respective arm lengths are about 0.8 of the full wavelength with respect to the upper bound of the desired operating frequency range.

19. The radiating element of claim 17, wherein the first and second dipole antennas have respective arm widths that are perpendicular to the respective arm lengths thereof, wherein the respective arm widths are greater than about one-half of the respective arm lengths.

20. The radiating element of claim 16, wherein the desired operating frequency range is about 1.4 GHz to about 2.7 GHz.

* * * * *